US005222257A

United States Patent [19]

Bachor

[11] Patent Number: 5,222,257

[45] Date of Patent: Jun. 29, 1993

[54] PROTECTIVE GARMENT

[76] Inventor: Edith Bachor, Fasanenstrasse 37, D-6233 Kelkheim-Hornau, Fed. Rep. of Germany

[21] Appl. No.: 768,364

[22] Filed: Sep. 27, 1991

[30] Foreign Application Priority Data

Nov. 13, 1990 [EP] European Pat. Off. ..... 90121676

[51] Int. Cl.[5] ..... A41D 13/00

[52] U.S. Cl. ..... 2/51; 2/69

[58] Field of Search ..... 2/46, 51, 69, 69.5, 2/70, 71, 72, 84, 79, 86, 88, 87, 89, 94, 105, 106, 227, 243 R, 243 B, DIG. 7; 5/482, 483, 484, 487

[56] References Cited

U.S. PATENT DOCUMENTS

| | | | |
|---|---|---|---|
| 1,603,501 | 10/1926 | Yenn | 2/84 |
| 2,072,644 | 3/1937 | McBee | 2/87 X |
| 2,414,048 | 1/1947 | LeSavoy | 2/243 B |
| 2,434,213 | 1/1948 | Kovary | 2/69 |
| 2,711,538 | 6/1955 | Cordero | 2/84 |
| 2,728,916 | 1/1956 | Clarke et al. | 2/84 X |
| 2,756,431 | 7/1956 | DeLuca, Jr. et al. | 2/87 |
| 2,911,651 | 11/1959 | Nye et al. | 2/87 X |
| 3,014,218 | 12/1961 | Smith | 2/87 |
| 3,594,821 | 7/1971 | Pierron | 2/243 X |
| 3,747,122 | 7/1973 | Goldberg | 2/69 X |
| 3,815,153 | 6/1974 | Vitol | 2/51 |
| 3,849,803 | 11/1974 | Connors | 2/84 |
| 3,946,443 | 3/1976 | Knight | 2/84 X |
| 4,118,802 | 10/1978 | Polster | 2/84 |
| 4,287,612 | 9/1981 | Tanaka | 2/243 R |
| 4,313,229 | 2/1982 | Villafane | 2/84 |
| 4,507,805 | 4/1985 | Calutoiu | 2/69.5 |
| 4,541,128 | 9/1985 | Will et al. | 2/84 |
| 4,783,856 | 11/1988 | Bouwens | 2/87 |
| 4,977,632 | 12/1990 | Ong | 2/69.5 X |
| 5,101,513 | 4/1992 | Bowers | 2/84 |

FOREIGN PATENT DOCUMENTS

| | | | |
|---|---|---|---|
| 223557 | 3/1962 | Austria | 2/88 |
| 0235556 | 1/1987 | European Pat. Off. . | |
| 2567726 | 1/1986 | France | 2/72 |
| 2115686 | 9/1983 | United Kingdom | 2/88 |

*Primary Examiner*—Clifford D. Crowder
*Assistant Examiner*—Jeanette E. Chapman
*Attorney, Agent, or Firm*—Peter K. Kontler

[57] ABSTRACT

A protective garment for use as overalls or trousers or as a pullover or jacket is made of a rectangular blank having two overlapping panels which are connected to each other along the two longitudinally extending marginal portions of the blank and, if necessary, along one transversely extending marginal portion. A first row of perforations is provided to form an elongated tongue starting at the one transversely extending marginal portion and extending midway between the longitudinally extending marginal portions toward but well short of the other transversely extending marginal portion. The perforations are surrounded by a welded or otherwise formed seam which converts the blank portions flanking the tongue into two tubes to constitute the leggins or the sleeves of a garment. The tongue is provided with one or more rows of perforations to form at least one strip which can be detached to be used as a sash or to form three strips, one to be used as a sash and the other two to be used to tie the leggins or sleeves to the legs or arms of the wearer. The blank has two weakened portions which are adjacent the other transversely extending marginal portion and can be destroyed to form two straps which are placed over the shoulders or are received in the crotch of the wearer.

20 Claims, 1 Drawing Sheet

PROTECTIVE GARMENT

BACKGROUND OF THE INVENTION

The invention relates to improvements in garments, particularly for use as rainwear or as protective garments in hospitals, chemical plants, nursing homes, convalescent homes, beauty salons, homes or apartments and many other establishments. Still more particularly, the invention relates to improvements in garments which can be obtained by conversion of blanks having two panels or layers of flexible sheet material, such as metallic or plastic foil, textile material, paper or the like.

Commonly owned European Pat. No. 0 235 556 granted Jan. 16, 1991 to Edith Bachor discloses a protective garment which can be obtained by converting a twin-layer or twin-panel blank of foil or non-woven textile material. As a rule, the material is a metallic or a plastic foil which can be welded by the application of heat and/or pressure. However, the patented garment can also consist of any one of a plurality of different textile materials, particularly those made of plastic filaments and/or spunbonded materials. The blank which is to be converted into the patented garment constitutes a length of flattened hose or tube and has two tubular portions which can constitute the leggins of a garment to be used as overalls or trousers, or the sleeves of an article of clothing to be used as a pullover, jacket or vest. By sealing a transversely extending marginal portion of the blank which is adjacent the free ends of the tubular portions, the blank can be converted into a garment with sleeves or leggins which are closed at their free ends. If the blank is converted into overalls with leggins having closed free ends, the material of the overalls is stretched when the wearer is in motion, i.e., the length of the leggins increases and the crotch of the overalls descends so that it is ultimately likely to interfere with movements of the legs. This can be defined as a so-called sleeper or bunny pajamas effect. Attempts to reduce the likelihood of undesirable downward migration of the crotch include the utilization of a belt or sash. However, a belt or sash must be produced in a separate operation which contributes to the cost of the protective garment.

Swiss Pat. No. 540 019 granted Aug. 15, 1973 to Wolfgang Patzold et al. discloses an apron made of a blank having a lower marginal portion which can be separated to form a sash or belt which is applied around the waist of the wearer of the apron.

Disposable protective garments of plastic foil or the like are often obtained by converting rectangular blanks which adhere to each other end-to-end along rows or lines of weakened portions which must be destroyed in order to separate a blank from the neighboring blank. The blanks form a long row or strip which is normally convoluted onto a core to form a roll containing a large number of blanks and occupying a relatively small amount of space in storage or during transport. If the blanks are converted into aprons of the type disclosed in the Swiss patent to Patzold et al., the separable marginal portions are located between neighboring blanks and are likely to be separated with wrong blanks, i.e., a blank which is separated from the neighboring blank can be detached in such a way that its marginal portion (which is intended to be converted into a sash) continues to adhere to the neighboring blank. Thus, it can happen that a particular blank does not carry a separable sash but the neighboring blank is provided with two sashes. Moreover, the length of the sash which is to be formed in accordance with the teaching of the Swiss patent does not suffice to form a sash or belt of requisite length. This can create problems when the protective garment is to be applied over a regular garment or if the protective garment is to be worn by a corpulent person.

OBJECTS OF THE INVENTION

An object of the invention is to provide a protective garment which is more comfortable than heretofore known garments.

Another object of the invention is to provide a garment which is more versatile than conventional protective garments.

A further object of the invention is to provide a blank which can be converted into a protective garment of the above outlined character.

An additional object of the invention is to provide a blank which can be converted into overalls or trousers, a pullover, a jacket or a vest without any or with minimal changes in its design.

Still another object of the invention is to provide a blank which can be designed to yield a garment to be worn by corpulent or slender persons with the same degree of comfort.

A further object of the invention is to provide a blank which can be provided with a belt or sash without risking separation of the sash from the blank when the latter is detached from a neighboring blank of a short or long series of interconnected blanks.

Another object of the invention is to provide a novel and improved method of forming a blank of the above outlined character.

An additional object of the invention is to provide a blank which can be formed in such a way that it carries its own strips or straps for tightening the sleeves or the leggins of the protective garment around the arms or legs of the wearer.

Another object of the invention is to provide a blank which can be obtained from a simple sheet of flexible textile material, metallic foil, plastic foil or the like.

An additional object of the invention is to provide a blank which can be converted into a protective garment, such as overalls or trousers, a pullover, a jacket or the like, with a minimum of effort and with little loss in time.

A further object of the invention is to provide a simple and inexpensive blank which can be mass produced in available machines.

SUMMARY OF THE INVENTION

The invention is embodied in a garment, particularly in a disposable protective garment. The improved garment comprises an elongated blank including two overlapping panels of sheet material (such as metallic and/or plastic foil or a non-woven textile material). The blank has two preferably parallel longitudinally extending first marginal portions where the panels are connected to each other and two transversely extending second marginal portions. If they are connected to each other transversely of the first marginal portions, the panels are connected to each other at most along one of the two second marginal portions. The blank is further provided with a first parting line surrounding an elongated (e.g., tongue-like) portion of the blank which extends from the one toward but short of the other second marginal portion and is spaced apart from the first marginal portions. Still further, the blank has a seam which connects the panels to each other and surrounds the first parting line. At least one second parting line is provided in the elongated portion of the blank and extends substantially longitudinally of the elongated portion. The panels define two tubular portions or sections which can be used as leggins or as sleeves (depending on the intended use of the garment as trousers or overalls, a jacket, a vest or a pullover) and each of which is bounded by a portion of the seam, by one of the first marginal portions and by the one second marginal portion. The elongated portion of the blank is disposed between the two tubular portions or sections.

The seam can constitute a welded seam provided, of course, that the material of the panels is a weldable material such as metallic or plastic foil or a non-woven textile material consisting of or containing weldable plastic fibers or filaments.

The elongated portion of the blank has a first end at the one second marginal portion and a second end between the two second marginal portions, and the at least one second parting line extends from the one toward but preferably short of the other end of the elongated portion, preferably from the first end toward but short of the second end.

The first parting line can be interrupted at a plurality of locations. Such locations preferably include a first location at one side and a second location at the other side of the elongated portion of the blank, and the first and second locations are preferably disposed at the same or nearly the same distance from the one second marginal portion. Such distance preferably at most equals but can be less than one-third the length of the elongated portion of the blank.

The blank can be provided with a third parting line in the elongated portion. The second and third parting lines preferably divide the elongated portion of the blank into three strips which extend longitudinally of the elongated portion and include a median strip and two outer strips flanking the median strip.

At least one of the parting lines can include rows of perforations in the panels, and at least the second and/or third parting line can have an undulate shape.

That portion of the seam which is remote from the one second marginal portion of the blank can surround a preferably circular or substantially circular second portion of the blank. The second portion is located between the elongated portion and the other second marginal portion of the blank.

Still further, the blank can be provided with two weakened portions (e.g., in the form of slits or rows of perforations) which are adjacent and preferably at least substantially parallel to the other second marginal portion. Each such weakened portion extends from one first marginal portion toward but short of the other first marginal portion of the blank. This enables one of the panels to define a bib which is disposed between the weakened portions (and can extend all the way to the other second marginal portion) and the elongated portion of the blank. Furthermore, the weakened portions of the blank enable the panels to define two straps each of which is disposed between one of the weakened portions and the other second marginal portion of the blank.

The panels can constitute halves of a flattened hose. Alternatively, the panels can together form a sheet of flexible material; the sheet has two contacting (e.g., slightly overlapping) edges between and two fold lines at the first marginal portions of the blank. The contacting edges can be located at least substantially midway between the fold lines. The seam and the first parting line include first portions which are preferably located between the contacting edges and one of the fold lines, and second portions which are disposed between the contacting edges and the other fold line.

Each first marginal portion of the blank can include two layers of the first panel and two layers of the second panel. Such first marginal portions preferably have a W-shaped or M-shaped cross-sectional outline.

The novel features which are considered as characteristic of the invention are set forth in particular in the appended claims. The improved garment itself, however, both as to its construction and the mode of manipulating the same, together with additional features and advantages thereof, will be best understood upon perusal of the following detailed description of certain presently preferred specific embodiments with reference the accompanying drawing.

DESCRIPTION OF PREFERRED EMBODIMENTS

Figure 1:
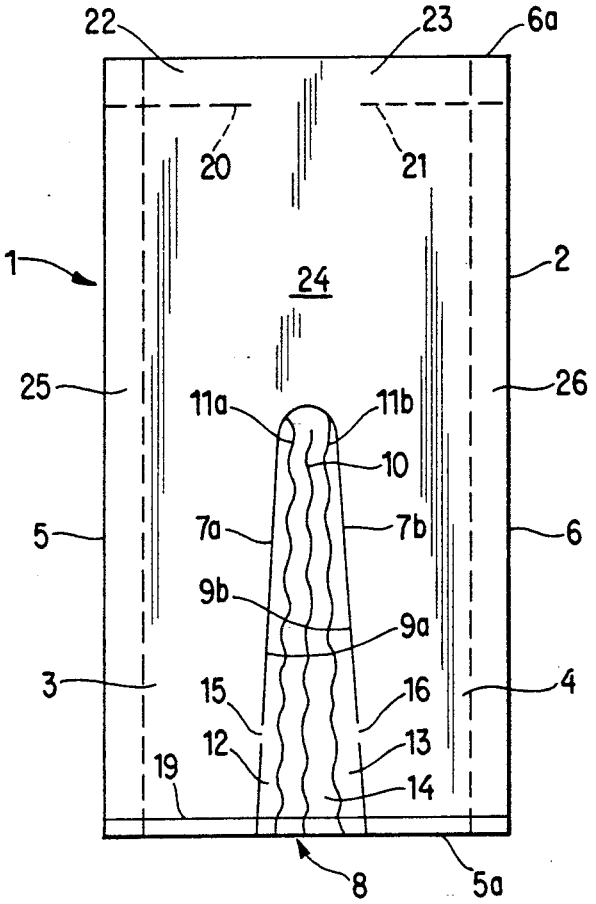
FIG. 1 is a plan view of a rectangular blank which can be converted into overalls and is made in accordance with a first embodiment of the invention.
Figure 2:
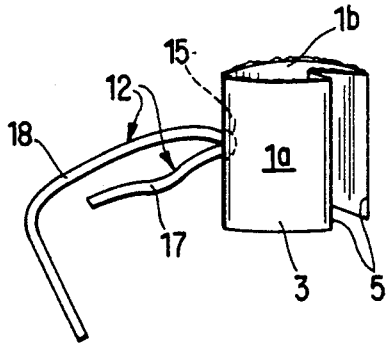
FIG. 2 is a fragmentary perspective view of a portion of one leggin of the overalls which can be obtained from the blank of FIG. 1, and further showing the two portions of a strip which can be tied around the leggin.

FIG. 1 shows a dispensible protective garment which comprises an elongated rectangular blank 1 consisting of two overlapping sheet-like panels 1*a* and 1*b* (FIG. 2). The blank 1 has two parallel elongated first marginal portions 5, 6 and two parallel second marginal portions 5*a*, 6*a* extending at right angles to the first marginal portions. The blank 1 can be converted into overalls with two tubular leggins 3, 4, a bib 24 and two shoulder straps 22, 23. The material of the panels 1*a*, 1*b* can be a metallic or plastic foil or a non-woven fabric, and the blank 1 is a flattened hose having two halves each of which constitutes one of the two panels. The illustrated panels 1*a*, 1*b* are of identical size and shape, and the bib 24 is formed by that panel which is located in front when the blank 1 is converted into overalls and the overalls are actually worn by a person.

The panels 1*a*, 1*b* are connected to each other (they are of one piece) along the first marginal portions 5, 6, along the second marginal portion 5*a* (by a seam 19) and along a U-shaped seam 7*a*, 7*b* between the leggins 3, 4. The seam 7*a*, 7*b* immediately surrounds a U-shaped parting line 9*a*, 9*b* which, in turn, surrounds an elongated portion 8 (hereinafter called insert for short) of the blank 1. The insert 8 extends from the marginal portion 5*a* toward but well short of the marginal portion 6*a* and is disposed between the leggins 3, 4. If the material of the blank 1 permits it, the seam 19 and/or the seam 7*a*, 7*b* is a welded seam, and the seam 7*a*, 7*b* ensures that each of the two leggins is a tube which extends between one of the marginal portions 5, 6 and the respective half of the seam 7*a*, 7*b*. The free ends of the leggins 3, 4 are closed by the respective portions of the seam 19.

The insert 8 is provided with a second parting line 10 which has an undulate shape and extends longitudinally of the insert from that end which is adjacent the marginal portion 5*a* toward but preferably slightly short of the other end of the insert. A third parting line including two undulate sections 11*a*, 11*b* cooperates with the parting line 10 to divide the insert 8 into three elongated strips, namely a central or median strip 14 located between the two halves 11*a*, 11*b* of the third parting line (and being provided with the parting line 10), and two outer strips 12, 13 which flank the median strip 14 and each of which preferably adheres to one of the leggins 3, 4. The locations 15 and 16 where the U-shaped parting line 9*a*, 9*b* is interrupted are provided at a distance from the marginal portion 5*a* which is preferably less than, or does not exceed, one-third the length of the insert 8 (as measured from the marginal portion 5*a* toward the marginal portion 6*a*).

Each of the three parting lines (9*a*, 9*b*; 10; 11*a*, 11*b*) can comprise a row of registering perforations in each of the panels 1*a*, 1*b* so that the strips 12, 13 can be readily separated from the strip 14, that the strip 14 can be readily converted into a lengthened sash or strip having approximately twice the length of the insert 8 (by breaking the material of the insert along the parting line 10), and that each of the strips 12, 13 can be nearly fully separated from the adjacent leggin 3, 4 (except at the locations 15 and 16).

Each of the parting lines 9*a*, 9*b* and 10 and 11*a*, 11*b* is located between two welded seams, i.e., the two panels 1*a*, 1*b* adhere to each other all the way around the U-shaped parting line 9*a*, 9*b* as well as all the way within this parting line, the same as at both sides of the parting line 10 and at both sides of the parting line 11*a*, 11*b*. This ensures that the leggins 3, 4 are flattened tubes and that each of the strips 12, 13, 14 consists of two layers, namely of a portion of the panel 1*a* and an identical portion of the panel 1*b*. The making of parting lines preferably takes place simultaneously with the making of seams at both sides of each of these parting lines. Combined sealing and severing or perforating tools which operate with heat and/or pressure and are used in connection with the treatment of sheets of thermoplastic and other weldable materials are well known in the art and need not be described here.

It is not absolutely necessary that each of the parting lines 9*a*, 9*b* and 10 and 11*a*, 11*b* be formed by providing the panels 1*a*, 1*b* with rows of perforations. It is equally within the purview of the invention to merely weaken the material of at least one of the panels 1*a*, 1*b* so that the blank 1 can be readily converted into overalls with a minimum of effort, i.e., that the blank can be readily torn along each of the three parting lines in order to obtain a strip 12 which adheres to the leggin 3 at 15, to obtain a strip 13 which adheres to the leggin 4 at 16, and to obtain a strip 14 which is completely separated from the strips 12, 13 and can be lengthened by breaking the parting line 10 in order to thus convert the strip 14 into a belt or sash which has a length nearly twice that of the insert 8 and preferably greatly exceeding the distance between the marginal portions 5 and 6.

FIG. 2 shows a portion of the leggin 3 and the strip 12 which continues to adhere to the leggin 3 at the location 15. The strip 12 includes a longer portion 18 and a shorter portion 17. When the overalls are worn by a person, the longer portion 18 is looped around the leggin 3 and is tied to the shorter portion 17 to ensure that the leggin 3 adheres to the respective leg or to the leg of trousers which are worn under the overalls.

By placing the locations 15, 16 rather close to the marginal portion 5*a*, one ensures that the portion 18 of the strip 12 (and the corresponding portion of the strip 13) can be caused to surround the leg of the wearer beneath the respective knee. Another advantage of the aforedescribed selection of the distance of locations 15, 16 from the marginal portion 5*a* is that, if the wearer forgets to tie the longer portions 18 to the respective shorter portions 17, the longer portions 18 are in contact with and are dragged along the ground or floor which acts as a reminder to the wearer to connect each longer portion 18 to the respective shorter portion 17 because the wearer of the overalls is likely to be uncomfortable if she or he knows that the longer portion 18 of the strip 12 and/or 13 is being dragged along the ground. Still further, by tying the strips 12, 13 around the respective leggins 3 and 4, the wearer avoids the so-called sleeper or bunny pajamas effect. Thus, since the leggins 3 and 4 are closed along the respective portions of the seam 19, the leg or the footwear of the wearer is not exposed and the legs tend to move the crotch (beneath the bib 24) of the overalls downwardly while the overalls are suspended on the shoulders of the wearer by the straps 22, 23. The crotch is much less likely to migrate toward the feet if the straps 12 and 13 are looped and tied around the leggins 3 and 4 when the overalls are in actual use.

The belt or sash which is obtained by splitting the median strip 14 of the insert 8 along the parting line 10 can be wrapped and tied around the waist of the person wearing the overalls, namely at a level above the leggins 3 and 4.

The undulate shape of the parting lines 10 and 11*a*, 11*b* is desirable and advantageous in many instances in that it enhances the comfort to the wearer. Thus, the strips 12, 13 and 14 exhibit fewer or no sharp edges which could cut the hands of the person tying the portions 17, 18 of the strip 12 or 13 or the hands of a person tying the sash around the waist above the leggins 3 and 4. Moreover, the undulate shape of the parting lines 10 and 11*a*, 11*b* contributes, though slightly, to elasticity of the straps 12 to 14. Still further, such undulate parting lines reduce the likelihood of breaking or tearing of the strips.

The blank 1 of FIG. 1 is further provided with two weakened portions 20, 21 which are preferably aligned with one another and are parallel to the marginal portion 6*a*. The weakened portion 20 extends from the marginal portion 5 toward but well short of the marginal portion 6, and the weakened portion 21 extends from the marginal portion 6 toward but well short of the marginal portion 5. When the bonds (if any) between the material of each of the panels 1*a* and 1*b* at the opposite sides of the weakened portions 20, 21 are destroyed (i.e., when each of these weakened portions is converted into a slit), the blank 1 develops the aforementioned shoulder straps 22 and 23. Thus, the person who is about to wear the overalls removes the strip 14, partly separates the strips 12, 13 from the respective leggins 3 and 4, destroys the material of the panels 1*a*, 1*b* along the weakened portions 20, 21, slips into the thus obtained overalls, inserts the hands through the slits which are obtained as a result of destruction of the material of the panels 1*a*, 1*b* along the weakened portions 20, 21, and places the straps 22, 23 over the respective shoulders of her or his body. The strip 14 is then converted into a sash which is tied around the overalls at the waist of the wearer, and the strips 12, 13 are placed around the respective leggins 3, 4 and tied to complete the preparations for actual use of the protective garment. The garment can be discarded after a single use or after a relatively small number of uses, depending on the extent of wear and contamination.

Since the panel 1*a* is identical with the panel 1*b*, the wearer can slip into the overalls in such a way that the bib 24 is formed by a portion of the panel 1*a* or 1*b*. The distance between the weakened portions 20, 21 suffices to provide a hole which is large enough for the neck and/or head of the wearer.

The panels 1*a* and 1*b* are doubled or folded at 25 and 26, i.e., along the first marginal portions 5 and 6. This can be readily seen in FIG. 2 which shows that the marginal portion 5 has a substantially W-shaped or M-shaped cross-sectional outline. An advantage of the dual layers of panels 1*a*, 1*b* at the fold lines 25 and 26 is that the size of the overalls is sufficient to ensure that the overalls can be worn by larger and smaller persons. The strips 12, 13 and the sash including the two halves of the strip 14 can compensate for bagginess if the overalls are worn by a slender person.

As mentioned above, the blank 1 can constitute a flat piece of hose made of plastic or other material which, save at 25 and 26, consists of only two layers. The insert 8 is confined between the flattened leggins 3, 4 before the blank 1 is converted into overalls so that the thickness of the entire blank is constant all the way from the fold line 25 to the fold line 26. This simplifies storage of the blank 1, e.g., in the form of one section of a series of coherent blanks together forming a long web which is preferably stored by convoluting it onto a core to form a roll.

Since the insert 8 extends longitudinally of the blank 1, such insert is not likely to become accidentally separated from the leggins 3, 4 when the blank 1 is detached from a neighboring blank along the second marginal portion 5*a* or 6*a*.

An important advantage of the improved protective garment is that the elongated insert 8 is located between the tubular portions or sections which constitute the leggins 3, 4 of the overalls. The material of the blank 1 between the leggins 3, 4 should be removed anyway in order to enhance the appearance of the overalls as well as to enhance the comfort of the wearer and, in accordance with the invention, the thus removed or at least partly removed material can be used to form the strip (sash) 14 as well as the strips 12 and 13. In other words, in lieu of simply removing and discarding some material of the blank 1 between the leggins 3 and 4, such material is used to reliably secure the leggins to the respective legs of the wearer and to obtain a sash or belt which prevents or greatly reduces the development of the aforediscussed sleeper effect if the free ends of the leggins are closed by the respective portions of the seam 19.

Another important advantage of the improved garment is that the thickness of the blank 1 between the leggins 3, 4 does not exceed the thickness of the major portion of the blank (between the fold lines 25 and 26). This facilitates convenient rolling up of the blank with numerous additional blanks on the core of a reel in order to ensure that the thus convoluted blanks will occupy a small amount of space. The feature that the thickness of the insert 8 does not exceed the thickness of adjacent portions of the blank 1 is of equal advantage when discrete blanks 1 are stacked on top of each other instead of being connected to one another end-to-end.

A further important advantage of the improved garment is that none of the material of the blank 1 is wasted. Thus, one starts with a preferably elongated rectangular blank 1, and each and every portion of this blank can be put to use. The placing of the seams immediately adjacent the respective parting lines also contributes to utilization of each and every portion of the blank as a part of a protective garment for use in households, hospitals and many other establishments.

The upper end (as viewed in FIG. 1) of the parting line 10 can terminate immediately adjacent or at a greater distance from the upper end of the insert 8, depending on the desired length of the sash or belt which is obtained by separating the section 14 from the sections 12, 13 and by splitting the section 14 along the line 10. If the line 10 extends close to the upper end of the insert 8, the length of the sash is nearly twice the length of such insert and is amply sufficient to tie the sash around the waist of an obese wearer of the overalls.

An advantage of undulate parting lines is that the strips 12, 13, 14 are less likely to injure the hands of the person in charge, that these straps are slightly more elastic, and that the apparatus or machine which is used to make the blank 1 is subject to less pronounced wear. This will be readily appreciated by bearing in mind that the tool or tools which weaken the blank 1 along the lines 10 and 11*a*, 11*b* does or do not contact one and the same portion of the conveyor which is used to transport the non-perforated blank past such tool or tools, i.e., the tool or tools and/or the conveyor must be moved back and forth in order to provide the insert 8 with undulate parting lines.

The length of the weakened portions 20, 21 can be selected with a view to conform to the height of the wearer. Thus, the overalls will fit a shorter person if the weakened portions 20, 21 are relatively short (because the straps 22, 23 are shorter), and the overalls will fit a taller person if the weakened portions 20, 21 are relatively long because this renders it possible to increase the distance between the closed ends of the straps 22, 23 and the marginal portion 5*a* when the weakened portions 20, 21 are destroyed and the thus obtained straps 22, 23 are bent through angles of 90° to extend in a direction away from the seam 19.

An advantage of a blank 1 which constitutes a hose or tube of plastic foil or the like is that the panels 1*a*, 1*b* are already connected to each other along the marginal portions 5 and 6. Thus, all that is necessary is to form the seams, the parting lines and the weakened portions (parting lines) 20, 21.

The fold lines 25, 26 exhibit the advantage that the width of the blank 1 is reduced accordingly but that the blank can be converted into overalls which can be worn by a slender person or by a corpulent person without any modifications. The exact manner in which a hose can be folded to provide the fold lines 25, 26 is well known in the relevant art.

Figure 3:
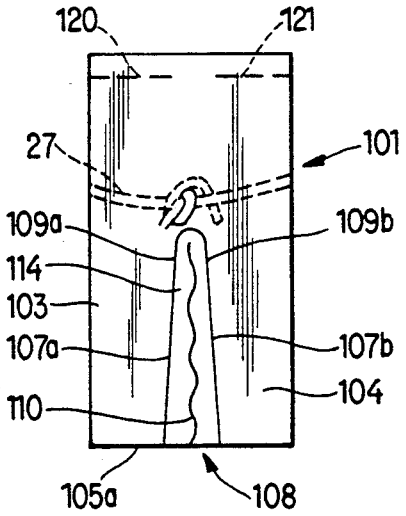
FIG. 3 is a smaller-scale plan view of a second blank which constitutes a first modification of the blank of FIG. 1 and can be converted into overalls without strips for tying around the leggins.

FIG. 3 shows a modified blank 101 which differs from the blank 1 in that the insert 108 can be converted into a single strip 114 to form a sash or belt 27 (indicated by broken lines). All such parts of the blank 101 which are identical with or clearly analogous to corresponding parts of the blank 1 are denoted by similar reference characters plus 100.

The insert 108 is merely provided with a single parting line 110 and the locations (15 and 16 in FIG. 1) where the material of the insert 108 could not be readily separated from the leggins 103, 104 are not provided in the blank 101. Thus, the insert 108 can be separated from the leggins 103, 104 along the parting line 109*a*, 109*b* and the thus separated insert 108 is split along the parting line 110 to form a sash or belt 27 which can be applied around the waist of the wearer of the overalls. In all other respects, the blank 101 is or can be identical with the blank 1.

The leggins 103, 104 are open at the marginal portion 105*a* because the blank 101 does not have a seam corresponding to the seam 19 of the blank 1.

Figure 4:
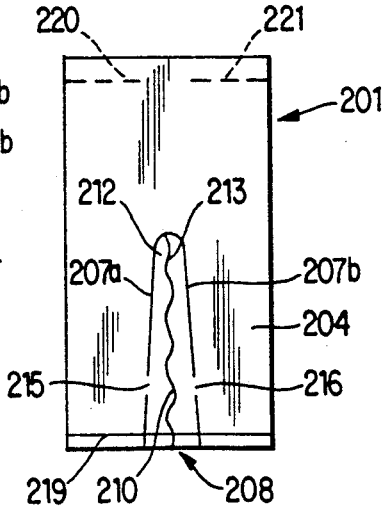
FIG. 4 is a similar plan view of a blank which constitutes a second modification of the blank of FIG. 1 and can be converted into overalls with strips to be tied around the leggins but without a belt.

Referring to FIG. 4, there is shown a third blank 201 which can be converted into overalls constituting a slight modification of the heretofore described overalls. All such parts of the blank 201 which are identical with or clearly analogous to corresponding parts of the blank 1 are denoted by similar reference characters plus 200. The main difference between the blanks 1 and 201 is that the insert 208 can be converted into two strips 212, 213 but does not yield a third strip which could be converted into a belt or sash. To this, end, the insert 208 has a longitudinally extending parting line 210 which extends all the way between the ends of this insert and can be destroyed to convert the insert 208 into strips 212 and 213. The strip 212 adheres to the leggin 203 at the location 215, and the strip 213 adheres to the leggin 204 at the location 216. Each of these strips can be tied around the respective leggin in a manner as described with reference to FIG. 2.

Figure 5:
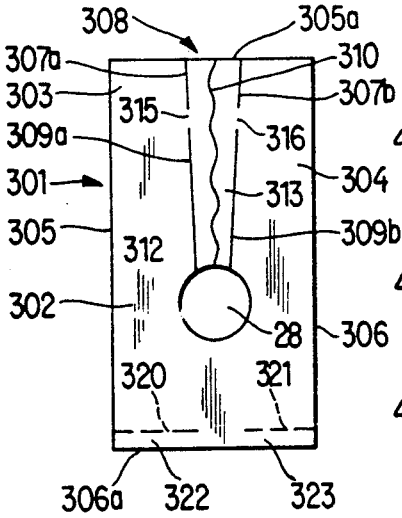
FIG. 5 is a similar plan view of a blank which can be converted into a pullover or into overalls and constitutes a modification of the blank which is shown in FIG. 4.

FIG. 5 shows a blank 301 wherein all such parts which are identical with or clearly analogous to corresponding parts of the blank 1 are denoted by similar reference characters plus 300. The blank 301 can be converted into a pullover- or jacket-like garment. The tubular portions 303, 304 are to constitute the two sleeves of the protective garment when the conversion of the blank 301 into a pullover or into a similar article of protective clothing is completed.

The parting line 309*a*, 309*b* includes a circular portion 309*c* which surrounds a substantially circular second portion 28 of the blank 301 at that end of the first portion or insert 308 which is remote from the marginal portion 305*a*. In all other respects, the blank 301 is identical with the blank 201 except that the seam 219 of the blank 201 is or can be omitted. The round second portion 28 of the blank 301 can be detached from the adjacent portions of the blank simultaneously with or prior or after partial separation of the insert 308 which is provided with a single centrally located undulate parting line 310 to permit the formation of two strips 312, 313 which respectively adhere to the tubular portions 303, 304 (as at 315, 316). These strips can be tied around the respective sleeves when the wearer has slipped the upper part of her or his body into the protective garment.

When the second portion 28 is removed by destroying the parting line 309*a*, 309*b*, 309*c* at 309*c*. the blank 301 is provided with an opening which suffices for the passage of the head of the wearer. The legs of the wearer can be caused to pass through slits which are formed as a result of destruction of the weakened portions 320, 321 and the thus obtained straps 322, 323 are located in the crotch when the garment is in use. This ensures, that the garment is properly held with respect to the upper portion of the wearer's body. If desired or necessary, the wearer or another person ties the strips 312, 313 around the respective sleeves 303, 304 to prevent slippage of the sleeves when the garment is in use.

The blank 301 can be converted into trousers if the round portion 28 is not removed. The straps 322, 323 are then used as shoulder straps and the tubular portions 303, 304 serve as leggins. In fact, the blank 301 can be converted into trousers or overalls even after the round portion 28 is detached from the adjacent portions of the panels.

The blanks 101, 201 and 301 can but need not be provided with fold lines corresponding to those shown in FIG. 1 at 25 and 26.

Figure 6:
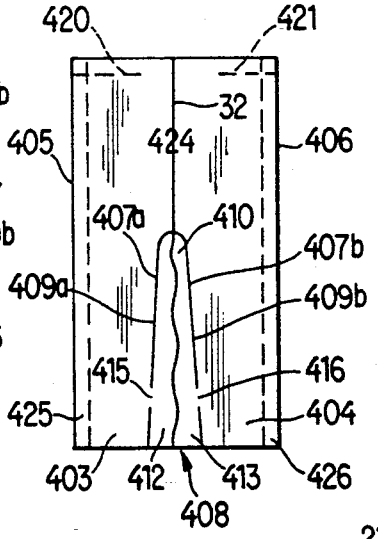
FIG. 6 is a plan view of a blank which constitutes a second modification of the blank of FIG. 4 and is made of a sheet rather than from a tube.
Figure 7:
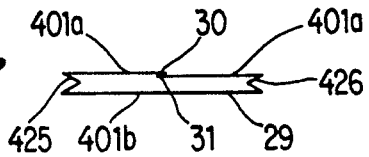
FIG. 7 is an end elevational view of the blank which is shown in FIG. 6.

Referring now to FIGS. 6 and 7, there is shown a blank 401 which is similar to the blank 101 of FIG. 3. All such parts of the blank 401 which are identical with or clearly analogous to corresponding parts of the blank 1 are denoted by similar reference characters plus 400. The main difference is that the blank 401 does not constitute a flattened hose but rather a suitably folded sheet 29 of flexible textile or other flexible material. The sheet 29 is folded so that its edges 30, 31 contact or preferably slightly overlap each other (FIG. 7) substantially or exactly at the center line 32 between the longitudinally extending marginal portions 405, 406 of the blank 401. Thus, the panel 401*a* includes two halves including the contacting edges 30, 31, and the panel 401*b* is of one piece. Each of these panels includes two layers at 425 and 426, i.e., at the marginal portions 405, 406 of the blank 401. It can be said that the sheet 29 includes four longitudinally extending sections or parts including a first section between the edge 30 and the fold line 425, two median sections between the fold lines 425, 426 and a fourth section between the fold line 426 and the edge 31. The first and fourth sections constitute the panel 401*a*, and the other two sections constitute the panel 401*b*.

The two halves of the seam 407*a*, 407*b* and the two halves of the parting line 409*a*, 409*b* are located at opposite sides of the center line 32 of the blank 401, and such halves of the parting line and of the adjacent seam can be mirror images of each other.

The seam 407*a*, 407*b* cooperates with the adjacent parts of the marginal portions 405, 406 to form the leggins 403, 404, and the insert 408 can be converted into strips 412, 413 by destroying the parting line 410 which, in this embodiment of the improved garment, preferably extends all the way between the two ends of the insert 408. The strips 412, 413 adhere to the respective leggins 403, 404 at 415, 416 and can be tied around such leggins in a manner as described with reference to FIG. 2.

The contacting edges 30 and 31 of the sheet 29 can but need not be connected (e.g., welded or adhesively bonded) to each other. If the panel 401*a* is located in front of the overalls and the edges 30, 31 are not connected to each other, the bib 424 of the overalls is slotted to afford access to the garment beneath the upper part of the overalls.

A bib 424 which is open along the center line 32 is preferred in many instances. However, it is equally within the purview of the invention to weld the edges 30, 31 to each other, either all the way or at least in the region of the bib 424. Such welding constitutes a simple operation if the edges 30, 31 at least slightly overlap each other. Instead of welding, the overlapping edges 30, 31 can be bonded to each other by resorting to a suitable adhesive.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A garment, particularly a protective garment, comprising an elongated blank including two overlapping panels of sheet material, said blank having two longitudinally extending first marginal portions at which said blanks are connected to each other and two transversely extending second marginal portions, said panels being connected to each other at most along one of said second marginal portions and said blank further having a first parting line surrounding an elongated blank portion which extends from said one second marginal portion toward but short of the other of said second marginal portions and is spaced apart from said first marginal portions, said blank further having a seam connecting said panels to each other and surrounding said first parting line, and at least one second parting line provided in and extending substantially longitudinally of said elongated portion, said panels defining two tubular portions which can be used as the sleeves or legging of the garment and each of which is bounded by a portion of said seam, by said one second marginal portion and by one of said first marginal portions, said elongated portion of said blank being disposed between said tubular portions and being at least partially separable from said panels.

2. The garment of claim 1, wherein said panels are foils.

3. The garment of claim 1, wherein said panels consist of non-woven textile material.

4. The garment of claim 1, wherein said seam is a welded seam.

5. The garment of claim 1, wherein said elongated portion has a first end at said one second marginal portion and a second end between said second marginal portions, said at least one second parting line extending from one of said ends toward but short of the other of said ends.

6. The garment of claim 1, wherein said locations include a first and a second location, said first and second locations being disposed at opposite sides of said elongated portion and being spaced apart substantially the same distance from said one second marginal portion.

7. The garment of claim 6, wherein said elongated portion of said blank has a predetermined length and said distance at most equals one-third of said predetermined length.

8. The garment of claim 1, wherein said blank has a third parting line which is provided in said elongated portion, said second and third parting lines dividing said elongated portion into three strips extending longitudinally of said elongated portion and including a median strip and two outer strips flanking said median strip.

9. The garment of claim 1, wherein at least one of said parting lines includes rows of perforations in said panels.

10. The garment of claim 1, wherein said first parting line includes a portion which is remote from said one second marginal portion and said blank includes a second portion which is surrounded by said portion of said first parting line.

11. The garment of claim 1, wherein said panels constitute halves of a flattened hose.

12. The garment of claim 1, wherein said panels together form a sheet of flexible material, said sheet having two contacting edges between said first marginal portions and two fold lines at said first marginal portions.

13. The garment of claim 12, wherein said contacting edges are located substantially midway between said fold lines.

14. The garment of claim 13, wherein said seam and said first parting line include first portions between said edges and one of said fold lines and second portions between said edges and the other of said fold lines.

15. The garment of claim 1, wherein each of said first marginal portions includes two layers of said first panel and said second panel.

16. The garment of claim 1, wherein said first parting line is interrupted at a plurality of locations.

17. The garment of claim 1, wherein at least said second parting line has a substantially undulate shape.

18. A garment, particularly a protective garment, comprising an elongated blank including two overlapping panels of sheet material, said blank having two longitudinally extending first marginal portions at which said panels are connected to each other and two transversely extending second marginal portions, said panels being connected to each other at most along one of said second marginal portions and said blank further having a first parting line surrounding an elongated blank portion which extends from said one second marginal portion toward but short of the other of said second marginal portions and is spaced apart from said first marginal portions, said blank further having a seam connecting said panels to each other and surrounding said first parting line, and at least one second parting line provided in and extending substantially longitudinally of said elongated portion, said blank also having two weakened portions adjacent and substantially parallel to the other of said second marginal portions, each of said weakened portions extending from one of said first marginal portions toward but short of the other of said first marginal portions.

19. The garment of claim 18, wherein one of said panels comprises a bib which is between said weakened portions and said elongated portion of said blank.

20. The garment of claim 18, wherein said panels define two straps each of which is disposed between one of said weakened portions and said other second marginal portion.

* * * * *